US010766506B2

(12) United States Patent
Huck et al.

(10) Patent No.: US 10,766,506 B2
(45) Date of Patent: Sep. 8, 2020

(54) SECURE STORAGE BOX FOR AUTORACK CAR

(71) Applicant: Trinity Rail Group, LLC, Dallas, TX (US)

(72) Inventors: Kenneth W. Huck, Fairview, TX (US); Jerry W. Vande Sande, Dallas, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 461 days.

(21) Appl. No.: 15/652,461

(22) Filed: Jul. 18, 2017

(65) Prior Publication Data

US 2018/0022366 A1 Jan. 25, 2018

Related U.S. Application Data

(60) Provisional application No. 62/364,107, filed on Jul. 19, 2016.

(51) Int. Cl.

| | |
|---|---|
| ***B61D 49/00*** | (2006.01) |
| ***G07C 9/00*** | (2020.01) |
| ***G07C 9/23*** | (2020.01) |
| ***B61D 3/18*** | (2006.01) |
| ***B61L 15/00*** | (2006.01) |

(52) U.S. Cl.

CPC ..... *B61D 49/00* (2013.01); *B61D 3/18* (2013.01); *G07C 9/00896* (2013.01); *G07C 9/23* (2020.01); *B61L 15/0072* (2013.01); *G07C 2009/00936* (2013.01)

(58) Field of Classification Search

CPC ..... B61D 49/00; B61D 3/18

See application file for complete search history.

(56) References Cited

U.S. PATENT DOCUMENTS

| | | | | |
|---|---|---|---|---|
| 5,823,598 | A * | 10/1998 | Clare | B60R 11/06 296/37.6 |
| 6,340,191 | B1 * | 1/2002 | Brady | B60R 3/00 280/164.1 |
| 10,173,603 | B2 * | 1/2019 | Dunham | B60R 9/065 |
| 10,479,258 | B2 * | 11/2019 | Souschek | B60L 53/14 |
| 2003/0200895 | A1 * | 10/2003 | Forbes | B61D 3/18 105/355 |
| 2006/0219746 | A1 * | 10/2006 | Kniffel | B60R 9/00 224/404 |

(Continued)

*Primary Examiner* — Jason C Smith

(74) *Attorney, Agent, or Firm* — Baker Botts, LLP

(57) ABSTRACT

According to some embodiments, a railcar comprises a railcar door for accessing an interior of the railcar, and a storage box comprising an access opening. The storage box is disposed such that when the railcar door is in a closed position, the railcar door prevents access to the storage box access opening, and when the railcar door is in an open position, the storage box access opening is accessible. In some embodiments the railcar door comprises a double door, and the storage box comprises a first portion coupled to a first door and a second portion coupled to a second door and adjacent to the first portion of the storage box. The first portion of the storage box prevents access to the second portion when the double doors are in a closed position. In some embodiments, the storage box is recessed into the railcar floor beneath the railcar door.

7 Claims, 8 Drawing Sheets

(56) References Cited

U.S. PATENT DOCUMENTS

| | | | | |
|---|---|---|---|---|
| 2007/0163905 | A1* | 7/2007 | Jorgenson | B60R 3/007 206/335 |
| 2008/0191506 | A1* | 8/2008 | Huotari | A47B 37/00 296/37.6 |
| 2011/0017094 | A1* | 1/2011 | Cencer | B61D 3/18 105/355 |
| 2012/0305565 | A1* | 12/2012 | Hansen | E05B 67/383 220/315 |
| 2013/0266411 | A1* | 10/2013 | Morgan | B60P 3/224 414/462 |
| 2017/0306663 | A1* | 10/2017 | Cencer | E05B 85/04 |
| 2018/0022366 | A1* | 1/2018 | Huck | G07C 9/23 105/422 |

* cited by examiner

SECURE STORAGE BOX FOR AUTORACK CAR

RELATED APPLICATIONS

This application claims priority to U.S. Provisional Application Ser. No. 62/364,107, entitled "SECURE STORAGE BOX FOR AUTORACK CAR," filed Jul. 19, 2016.

TECHNICAL FIELD OF THE INVENTION

This disclosure generally relates to railcars, and more particularly to secured storage for an autorack railcar.

BACKGROUND

An autorack railcar (also referred to as an auto carrier or car transporter) is a railcar for transporting automobiles and light trucks. For example, an autorack railcar may transport vehicles from a manufacturing facility to a distributorship, or transport vehicles for passengers of a passenger train service.

An autorack railcar generally includes two or three levels (or racks) for transporting vehicles. Some autorack railcars are convertible between two and three levels. To load an autorack railcar, a skilled driver drives the vehicle up a ramp and onto one of the racks. The driver or another crew member then secures the vehicle to the rack with tie down straps, chains, etc. The process is reversed to unload the autorack railcar.

Autorack cars are typically fully enclosed with continuous side panels, end doors, and roofs to protect the vehicles from severe weather, theft/vandalism, or other in-transit damage. Even vehicles shipped via fully enclosed autorack cars, however, may be subject to vandalism and theft. For example, thieves are particularly interested in the vehicle key fobs because the key fobs are reprogrammable and may be sold on the black market.

SUMMARY

According to some embodiments, a railcar comprises a railcar door for accessing an interior of the railcar, and a storage box comprising an access opening. The storage box is disposed such that when the railcar door is in a closed position, the railcar door prevents access to the storage box access opening, and when the railcar door is in an open position, the storage box access opening is accessible.

In particular embodiments, the railcar door comprises a double door. The double door comprises a first portion and a second portion. The storage box comprises a first portion coupled to the first portion of the double door and a second portion coupled to the second portion of the double door and adjacent to the first portion of the storage box. The first portion of the storage box is positioned such that the first portion of the storage box prevents access to the second portion of the storage box when the double doors are in a closed position, and the second portion of the storage box is accessible when the double doors are in an open position. The second portion of the storage box may further comprise a sliding panel.

In particular embodiments, the railcar further comprises a railcar floor, and the storage box is recessed into the railcar floor. The storage box may be recessed into the railcar floor at least partially beneath the railcar door and disposed such that the access opening of the storage box is inaccessible when the railcar door is in a closed position and accessible when the railcar door is in an open position.

In particular embodiments, the railcar comprises an autorack railcar and the storage box comprises storage for keys of vehicles loaded in the autorack railcar. The storage box may comprise a plurality of storage locations, and each storage location of the plurality of storage locations corresponds to a vehicle location within the autorack railcar.

According to some embodiments, a secure storage system for a railcar comprises a first storage portion comprising an access opening at one end, and a second storage portion. When the first storage portion is coupled to a first railcar door, and the second storage portion is coupled to a second railcar door adjacent the access opening of the first storage portion, access to the access opening of the first storage portion is prevented when the first railcar door and the second railcar door are in the closed position, and access to the access opening of the first storage portion is accessible when the first railcar door and the second railcar door are in the open position. The first storage portion may further comprise a sliding panel.

In particular embodiments, the secure storage system comprises storage for keys of vehicles loaded in an autorack railcar. The secure storage system may comprise a plurality of storage locations, and each storage location of the plurality of storage locations corresponds to a vehicle location within the autorack railcar.

According to some embodiments, a method of accessing a storage box of a railcar comprises accessing the interior of the railcar and obtaining a storage box identifier from the interior of the railcar. The storage box identifier at least uniquely identifies the railcar. The method further comprises transmitting a wireless message to an authentication entity. The wireless message includes the storage box identifier. The method further comprises receiving, from the authentication entity, an access code for the storage box and inputting the access code to an input device associated with the storage box.

In particular embodiments, the storage box identifier uniquely identifies the railcar and the storage box of the railcar. Transmitting the wireless message to the authentication entity may comprise transmitting the wireless message from a mobile communication device. The mobile communication device is associated with a unique identifier, and the wireless message further includes the unique identifier of the mobile communication device.

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Figure 1:
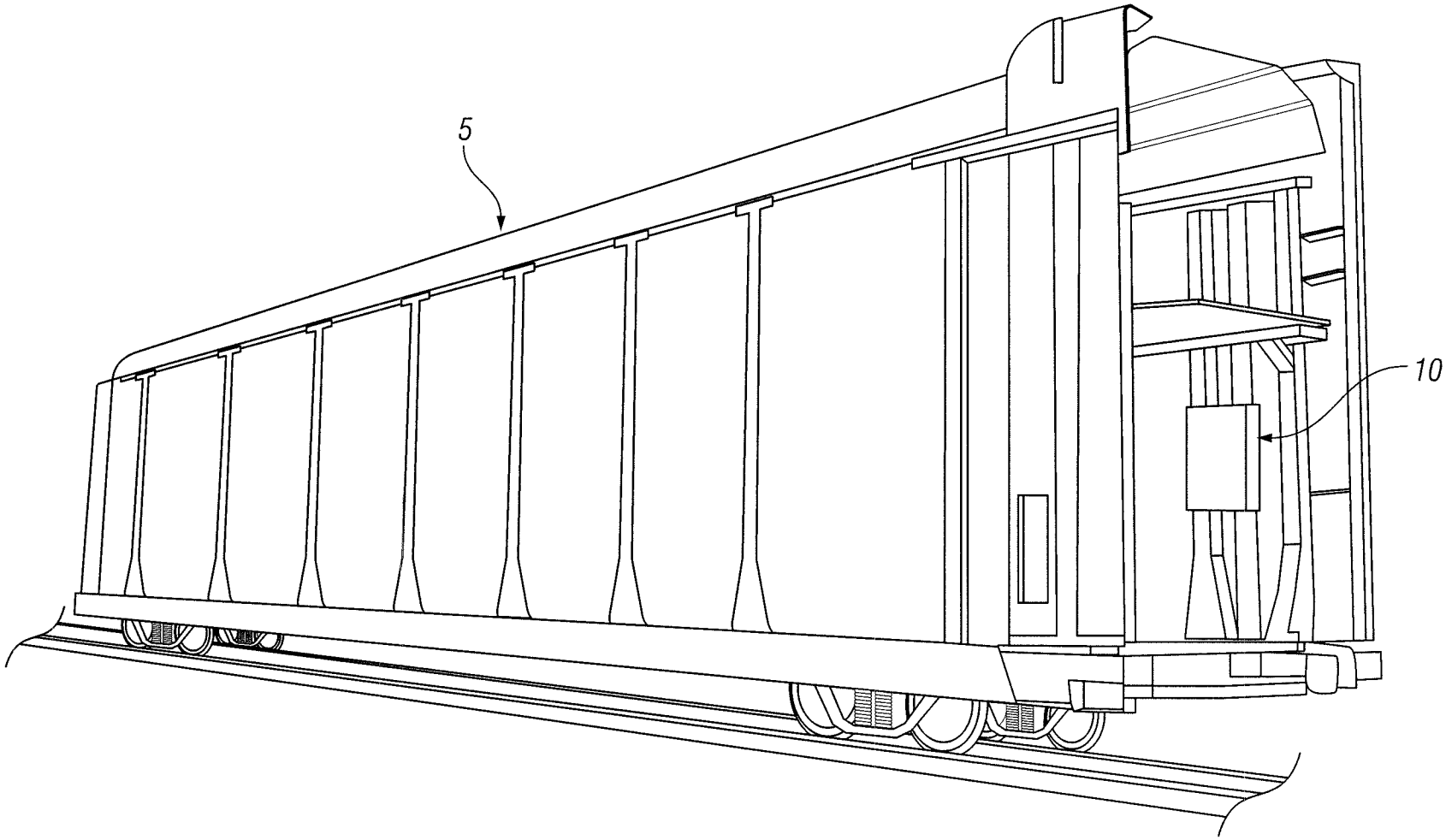
FIG. 1 is perspective drawing of an example autorack railcar, according to some embodiments.

An autorack railcar may transport vehicles from a manufacturing facility to a distributorship, or transport vehicles for passengers of a passenger train service. To load an autorack railcar, a skilled driver drives the vehicle up a ramp and onto one of the racks. The driver or another crew member then secures the vehicle to the rack with tie down straps, chains, etc. The process is reversed to unload the autorack railcar.

Autorack cars are typically fully enclosed with continuous side panels, end doors, and roofs to protect the vehicles from severe weather, theft/vandalism, or other in-transit damage. Even vehicles shipped via fully enclosed autorack cars, however, may be subject to vandalism and theft. For example, thieves are particularly interested in the vehicle key fobs because the key fobs are reprogrammable and may be sold on the black market.

Various methods have been attempted to minimize losses, such as reinforcing the autoracks to make them more difficult for unauthorized entry, by hiding vehicle keys and key fobs, by locking keys and key fobs in vehicles, or by storing keys and key fobs separate from the vehicles. These have had limited success or require complicated logistics to track and pass keys or access to the keys. A goal of any key storage system is to provide ready access to the keys and key fobs for inspections, unloading, etc.

The losses resulting from key and key fob theft to shippers can be significant. The losses include damage to the autorack car to gain access, damage to vehicles within the autorack car, replacement costs, as well as lost time. For example, vehicles in autoracks are typically unloaded with up to five autorack railcars attached together. The vehicles on one deck level are unloaded from all attached railcars by driving them all the way through the attached cars. If the keys or key fobs are stolen from any of the vehicles on a deck, it makes unloading of any vehicles behind the disabled vehicle difficult or impossible because the vehicles can only be unloaded by driving them toward one end of the attached railcars where the unloading ramp is located. Thus, railcars that contain vehicles with missing keys or key fobs may be taken out of the line of railcars and set off to the side until replacement keys arrive, or the entire string of attached railcars may be prevented from unloading until replacement keys arrive. This can be expensive and time consuming.

Other types of freight and tank cars may include critical systems that need protection. For example, critical systems such as refrigeration, control valves, or electronic controllers may require controlled access to prevent vandalism and/or theft.

Particular embodiments obviate the problems described above and include a lockable storage box for vehicle keys and/or key fobs. Particular advantages include reduced damage to autorack cars, and the vehicles within them, because the inaccessibility of the keys and fobs, a major target of thieves, may deter theft. Reducing theft occurrences has additional advantages that include reduced cost of operation by eliminating down time and replacement costs when keys and fobs are stolen. Particular embodiments provide another level of security for access to critical systems on various types of freight or tank railcars.

The terms "key box," "lock box," and "storage box" are used as a general term to refer to a storage location for vehicle keys, key fobs, manuals, or other vehicle parts that may be separate from the vehicle itself, or to store special tools or codes to access railcar components or systems.

An advantage of a secure key box attached to an autorack railcar is that keys and key fobs can be stored with the vehicles being transported while also maintaining a level of security to minimize theft. A secure storage box may deter thieves, and prevent damage to the autorack car and/or the vehicles inside, because a potential thief knows that the keys and fobs will not be easily obtained.

FIG. 1 is perspective drawing of an example autorack railcar, according to some embodiments. Autorack railcar 5 is a two-level autorack railcar. The end doors of autorack railcar 5 are open, revealing a portion of the interior of autorack railcar 5. Autorack railcar 5 includes storage box 10. In particular embodiments, storage box 10 may be attached to an interior wall of autorack railcar 5. In some embodiments, storage box 10 may be attached to the end doors of autorack railcar 5, recessed into the floor of autorack railcar 5, or any other suitable location within autorack railcar 5. Particular embodiments may include more than one storage box 10 (e.g., one storage box per level, one storage box at each end of autorack railcar 5, one storage box per parking location, etc.).

In particular embodiments, storage box 10 may store keys or key fobs associated with the vehicles loaded in autorack railcar 5. In some embodiments, storage box 10 may store manuals, vehicle parts that may be separate from the vehicle itself, special tools, or codes to access railcar components or systems.

Figure 2:
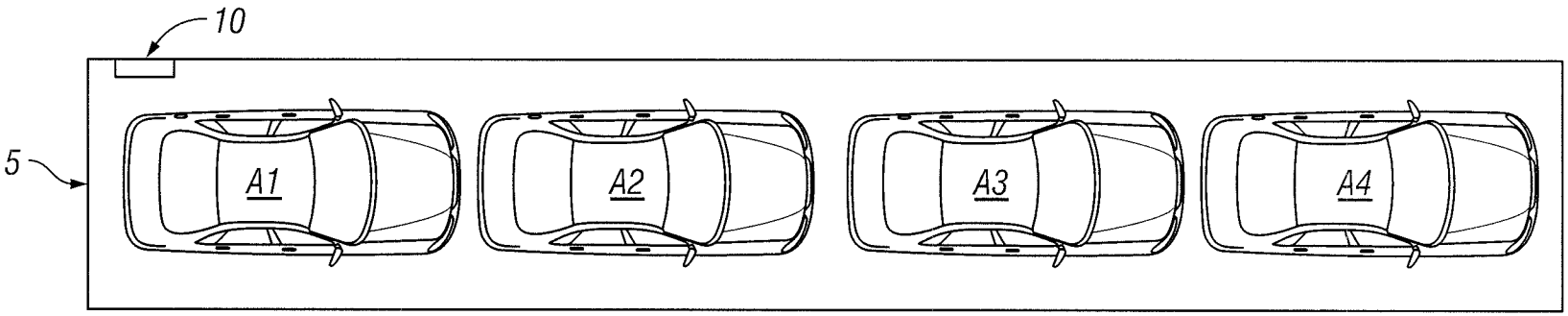
FIG. 2 is an overhead block diagram of an example autorack railcar interior, according to some embodiments.

FIG. 2 is an overhead block diagram of an example autorack railcar interior, according to some embodiments. In the illustrated embodiment, four vehicles are loaded on the A-deck of autorack railcar 5. The parking locations of the four vehicles may be referred to as A1, A2, A3, and A4 as labeled in the drawing. Parking locations on the B-deck and C-deck may be assigned similar identifiers. Autorack 5 also includes storage box 10. In particular embodiments, storage box 10 stores keys and key fobs associated with vehicles A1-A4.

Although four vehicles are illustrated, in other embodiments autorack railcar 5 may contain any suitable number of vehicles on any suitable number of levels. Storage box 10 may store keys for all vehicles contained in autorack railcar 5, for all vehicles contained in a particular level of autorack railcar 5, or for any suitable number of vehicles. Particular examples of storage box 10 are described in more detail below with respect to FIGS. 3-8B.

Figure 3:
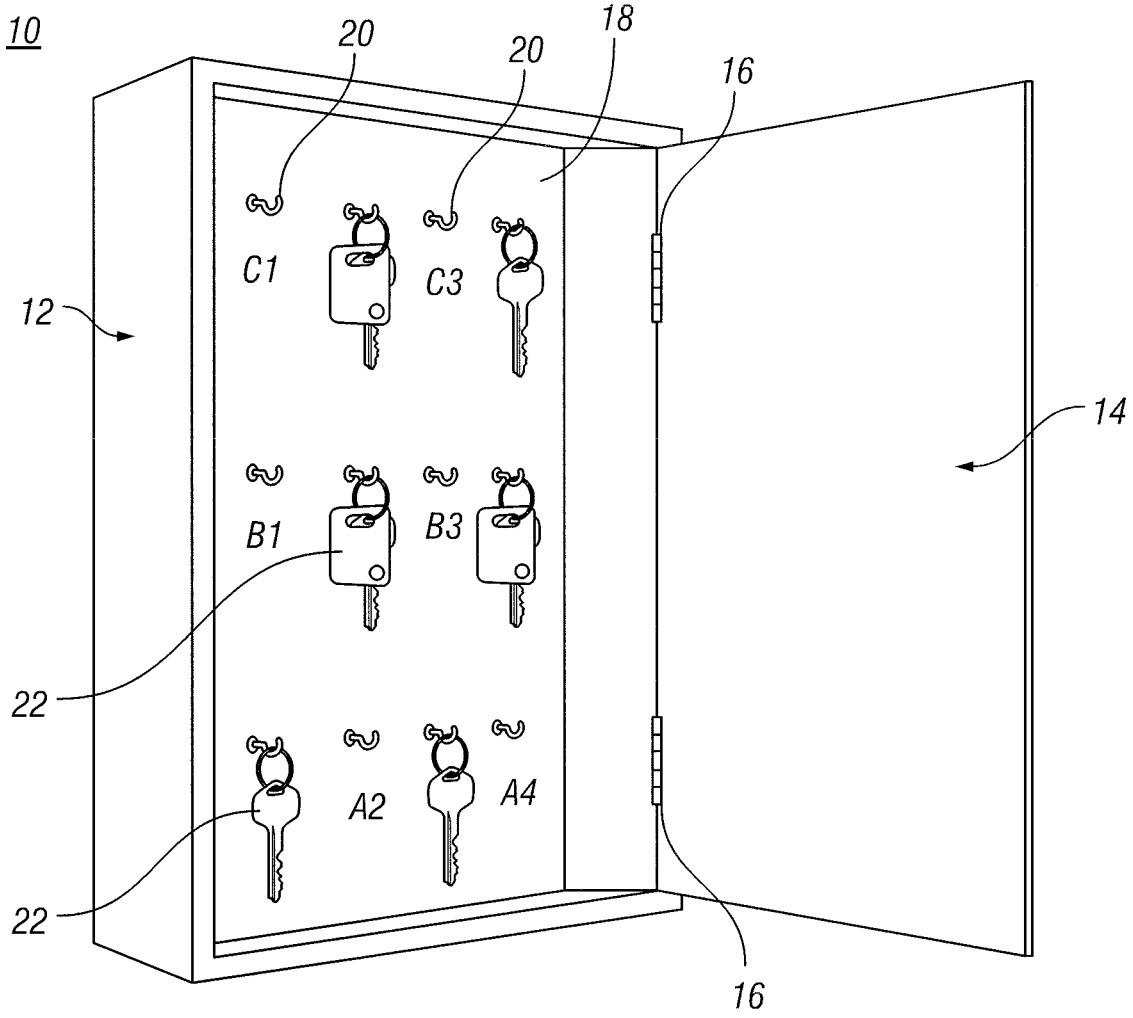
FIG. 3 is perspective schematic drawing of an example railcar storage box, according to some embodiments.

FIG. 3 is a perspective schematic drawing of an example railcar storage box, according to some embodiments. Storage box 10 includes storage compartment 12 and door 14.

Door 14 is coupled to storage compartment 12 via hinges 16. Storage compartment 12 includes key panel 18 with key retainers 20 for retaining keys 22. Keys 22 may refer to any number of keys and/or key fobs.

In particular embodiments, storage box 10 is constructed such that when storage box 10 is locked, storage box 10 is able to withstand substantial attempts to gain access or to prevent dislodgement and removal of storage box 10 from the railcar, such as autorack railcar 5. Storage box 10 may be tamper-resistant to withstand attempted unauthorized access. Storage box 10 may be securely mounted to the railcar to prevent prying loose, blows from sledgehammers, or other types of unauthorized removal.

In some embodiments, storage box 10 is bolted to the railcar structure using tamper-resistant fasteners, such as Huck bolts, or any other suitable fasteners. Huck bolts comprise smooth round heads on the outside of storage box 10 and a Huck bolt nut on the inside of storage box 10. Thus, removal of storage box 10 is only permitted with access to the inside of storage box 10. Additionally, door 14 of storage box 10 may be secured such that hinges 16 may not be easily removed. Door 14 may also have a locking mechanism. In some embodiments, storage box 10 may be welded to the railcar structure. In some embodiments, storage box 10 may be recessed into a floor or wall of autorack railcar 5.

Key panel 18 includes key retainers 20 for retaining keys 22. In the illustrated embodiment, retainers 20 comprise hooks for hanging keys 22. Other embodiments may include a variety of methods of retaining the keys and fobs 22 within storage box 10.

Particular embodiments accommodate ease of use, as well as the environment storage box 10 will be subjected to. For example, railcars may be subjected to accelerations in the longitudinal, lateral, and vertical directions. Keys and fobs 22 hanging from a hook may dislodge and possibly fall off the hook. If more than one set of keys or fobs 22 dislodges, an operator may waste considerable time determining which vehicle is associated with fallen keys or fobs 22.

In particular embodiments, a holding space, such as a hole or slot, may be used alone or in conjunction with a retention method to prevent key or fob dislodgement caused by, for example, vibration. In particular embodiments, a foam piece attached to the lock box door presses against the keys and fobs when it is closed, thereby holding them in place.

For example, the inside of door 14 may include a piece of foam approximately the same thickness as the depth of storage box 10. When door 14 is closed, the foam presses against keys 22 to hold them in place. In some embodiments, movable bars, clamps, or Velcro strips within storage box 10 may be put in place after keys and fobs 22 are stored to hold keys and fobs 22 securely in place. In some embodiments, key retainers 20 may comprise one or more pouches or sleeves for securing keys and fobs 22.

In the illustrated embodiment, door 14 is attached to the front of storage box 10 and may open outward into the interior of the railcar. In other embodiments, where interior space may be limited, such as in the space between an interior wall of autorack railcar 5 and vehicle A1 loaded in autorack railcar 5, storage box 10 may be configured to open sideways. An example is illustrated in FIG. 4.

Figure 4:
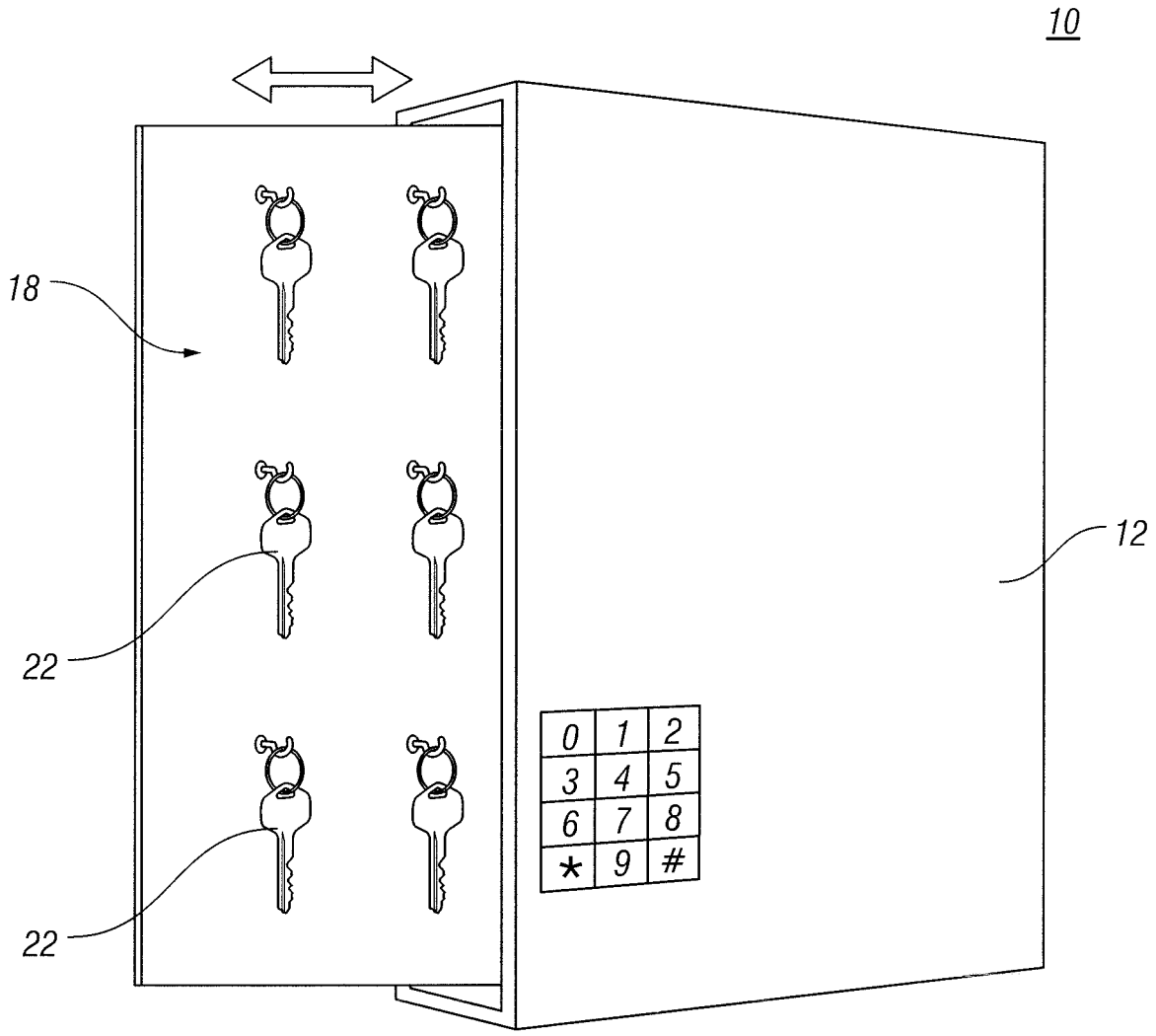
FIG. 4 is a perspective schematic drawing of another example railcar storage box, according to some embodiments.

FIG. 4 is a perspective schematic drawing of another example railcar storage box, according to some embodiments. Door 14 (not illustrated) may be hinged on the side of storage compartment 12 and may open along the railcar wall. Key panel 18 may be slidably coupled to storage compartment 12 and configured to slide in and out a side of storage compartment 12 (see illustrated arrows).

The interior of storage box 10 may have different configurations in various embodiments. For example, autorack railcars may have one, two or three decks on which vehicles may be transported. In particular embodiments, the interior of storage box 10 may have particular areas for storing keys and fobs 22 associated with the vehicle's location in the autorack.

In particular embodiments, a tri-level autorack storage box may have a storage section for the A-deck vehicles and separate storage sections for the B-deck and C-deck, respectively. For example, in the illustrated example of FIG. 3, key panel 18 includes three rows of key retainers 20. Keys 22 for A-deck vehicles may be located in the bottom row, keys 22 for B-deck vehicles may be located in the middle row, and keys 22 for C-deck vehicles may be located in the top row.

In particular embodiments, each section may further include a storage location associated with the vehicle's location on the autorack deck. For example, vehicles may be stored at locations such as A1, A2, A3, and A4 illustrated in FIG. 2, and their respective keys and fobs could be stored at correspondingly labeled locations within the lock box. In the illustrated embodiment, the first key retainer 20 on the bottom row may correspond to the first vehicle on the A-deck (e.g., A1), the second key retainer 20 on the bottom row may correspond the second vehicle on the A-deck (e.g., A2), and so forth. A particular advantage is that assigned locations help clarify which keys and fobs correspond to which vehicles, saving time. In some embodiments, a storage box may be located on each autorack deck (e.g., a box on the A-deck, a box on the B-deck, and a box on the C-deck).

Particular embodiments may include more than one key panel 18. For example, with respect to FIG. 3 storage compartment 12 may include two or three key panels 18 coupled via hinges to storage compartment 12. An operator may swing out a first key panel 18, like a page of a book, to access a second key panel 18 behind the first key panel 18. Each key panel 18 may be associated with a particular deck of an autorack car. With respect to FIG. 4, storage compartment 12 may include two or more sliding key panels 18. Other embodiments may include any suitable configuration of key panel 18 within storage compartment 12.

A secure key box may be located in various locations on the autorack car. In particular embodiments, a secure key box may be attached to the exterior of the autorack. In some embodiments, the secure key box may be attached to the interior of the autorack, such as inside the autorack in the A-deck area. The interior of the autorack car provides an additional layer of security because the autoracks themselves are locked and sealed, which makes unauthorized entry difficult.

In particular embodiments, the key box is lockable to provide another level of security. Methods of locking the key box may include, but are not limited to, keyed locks, boxes with hasps for attaching separate locks (e.g., padlock, electronic padlock, Bluetooth lock, etc.), combination locks, various types of manual or electronic key pads, wireless or other remote release, etc.

In particular embodiments, a key to unlock the storage box may be kept separate from the autorack and passed along between operators or other rail personnel as the autorack railcar is transported. A system to pass the key along with the autorack enables access to the vehicle keys whenever needed.

A key lock, however, may be vulnerable to being picked. In particular embodiments, a storage box may be secured with an access code instead of a key and the access code, instead of the key, may be passed along with the autorack as it is transported.

In some embodiments, an electronic key pad is used to secure the storage box using a two factor authentication for access. For example, using wireless technology (e.g., cellular, WiFi, RFID, etc.), an authorized person may contact a system that records the date, time, and authentication of the requestor and sends back to the requestor a key code. The requestor may use the received code to open the storage box.

Figure 5:
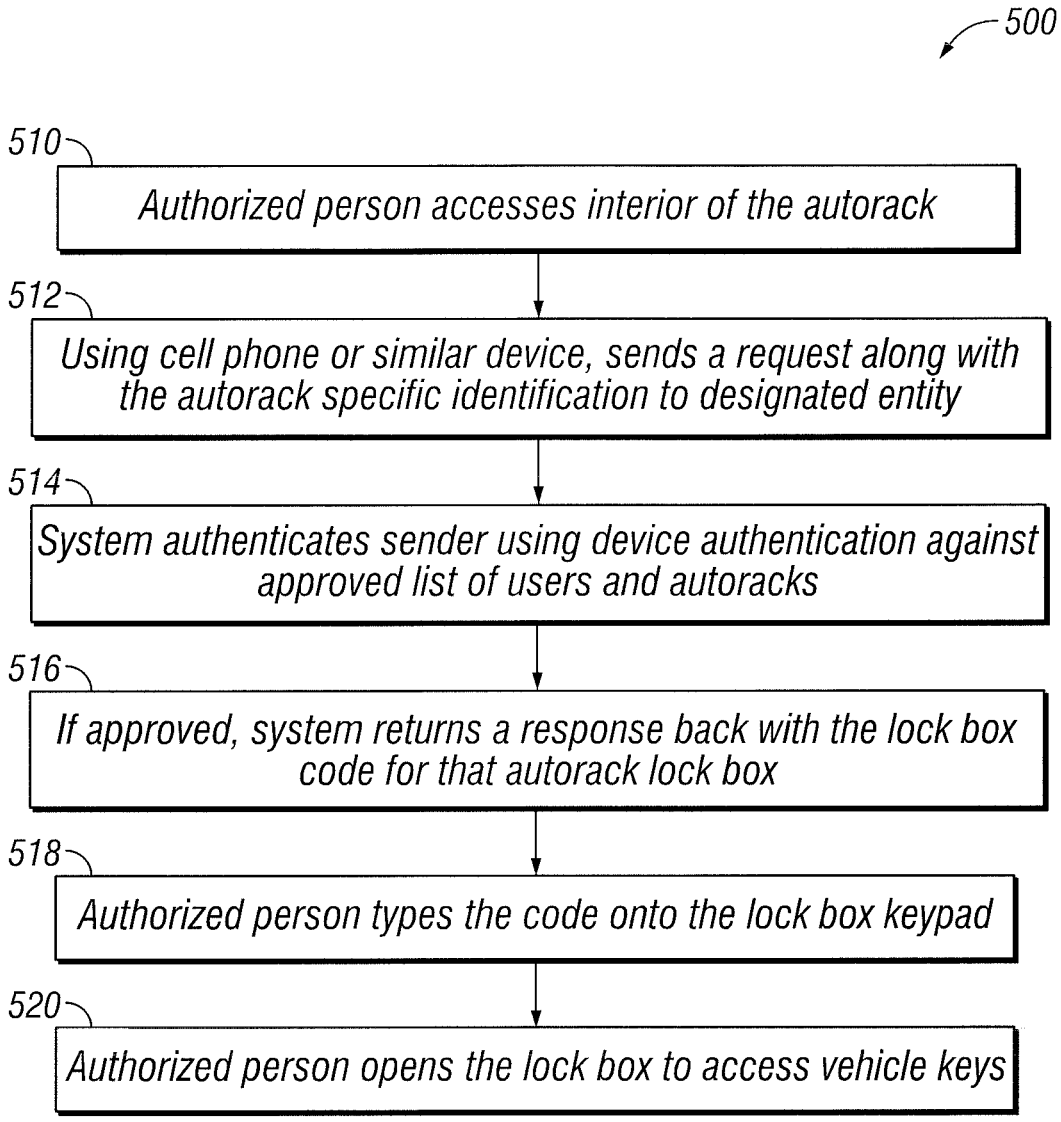
FIG. 5 is a flow diagram illustrating an example method of opening a storage box using two factor authentication, according to some embodiments.

FIG. 5 is a flow diagram illustrating an example method of opening a storage box using two factor authentication, according to some embodiments. In particular embodiments, one or more steps of method 500 may be performed to open a storage box, such as the railcar storage box described with respect to FIG. 3.

The method begins at step 510 where an authorized person accesses the interior of the railcar. For example, an operator authorized to load or unload vehicles from an autorack railcar may open the end doors of the autorack railcar.

At step 512, the authorized person sends a message that includes identification information associated with the autorack to a known authentication entity. For example, a unique identifier for the autorack may be printed on an interior portion of the autorack, or an identifier of a particular storage box within the autorack may be printed on or near the storage box. The identifier may comprise a combination of an autorack identifier and an identifier of a particular storage box within the autorack (e.g., identifier of A-deck storage box, B-deck storage box, etc.).

In particular embodiments the authorized person may send a text message using a cell phone. For example, the operator authorized to load or unload vehicles from an autorack railcar may text identification information printed on or near the storage box to the phone number of a known authentication entity.

At step 514, the authentication entity authenticates the sender (i.e., the authorized person). In particular embodiments, the authentication entity may authenticate the sender by comparing the sender's device identification with an approved list of devices and associated autoracks. Other embodiments may use any suitable form of device authentication.

At step 516, the authentication entity sends a message back to the sender (i.e., the authorized person) with an access code for the storage box. In particular embodiments, the authentication entity may send a text message containing an access code to the authorized person's cell phone.

At step 518, the authorized person enters the code at an input device associated with the storage box (e.g., storage box keypad, combination lock, etc.). For example, the operator authorized to load or unload vehicles from an autorack railcar enters the access code received in a text message on a keypad associated with the storage box inside the autorack railcar. In some embodiments, the same code may open more than one storage box within the autorack railcar.

At step 520, the authorized person opens the storage box to access the vehicle keys. For example, the operator authorized to load or unload vehicles from an autorack railcar opens to storage box to retrieve keys and begin unloading vehicles.

Modifications, additions, or omissions may be made to the method of FIG. 5. Additionally, one or more steps in method 500 of FIG. 5 may be performed in parallel or in any suitable order.

Particular embodiments may change the key code as needed. An example is illustrated in FIG. 6.

Figure 6:
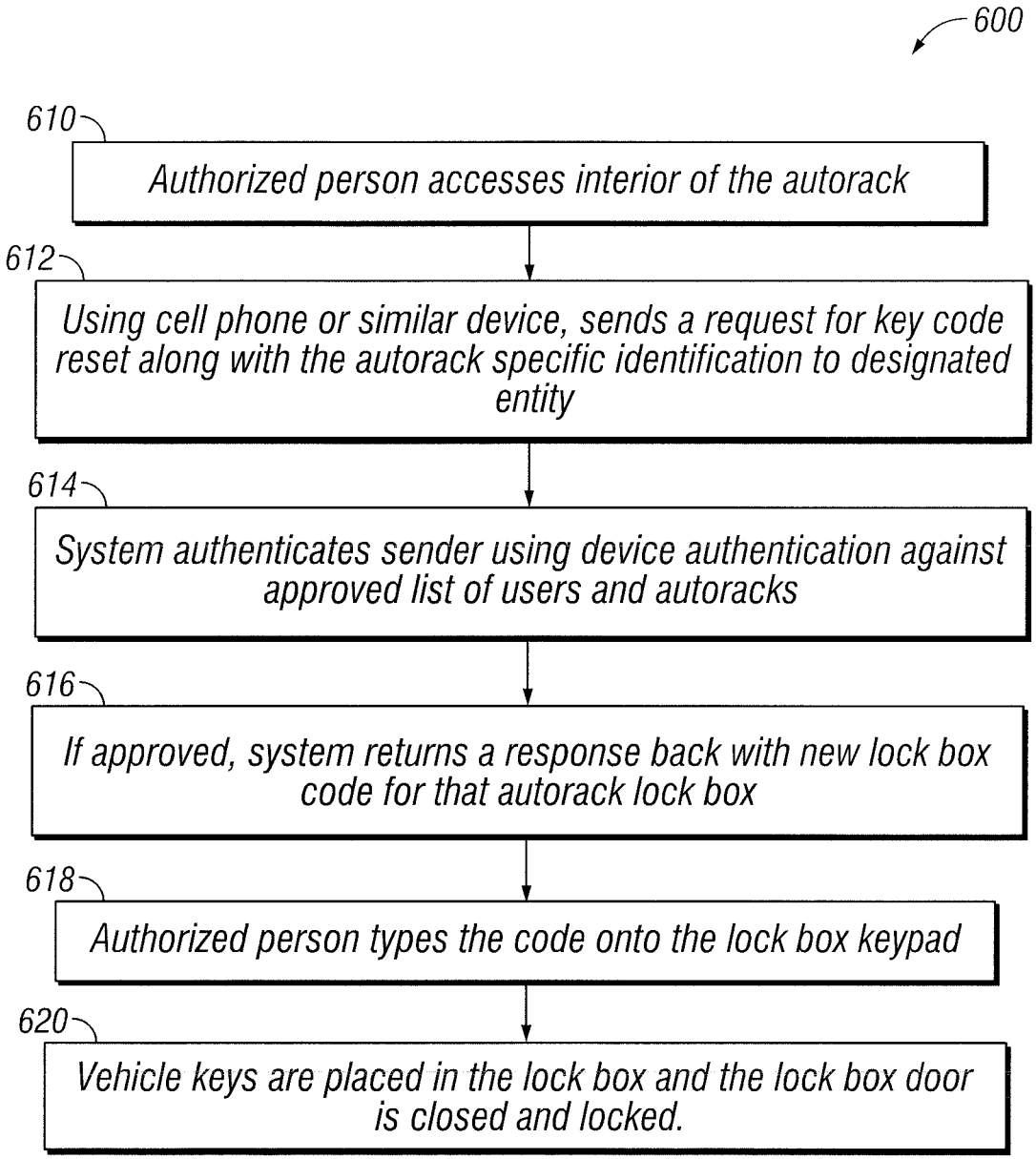
FIG. 6 is a flow diagram illustrating an example method of resetting a storage box code using two factor authentication, according to some embodiments.

FIG. 6 is a flow diagram illustrating an example method of resetting a storage box code using two factor authentication, according to some embodiments. In particular embodiments, one or more steps of method 600 may be performed to reset a storage box code, such as a code associated with the railcar storage box described with respect to FIG. 3.

The method begins at step 610 where an authorized person accesses the interior of the railcar. For example, an operator authorized to load or unload vehicles from an autorack railcar may open the end doors of the autorack railcar.

At step 612, the authorized person sends a message that requests an access code reset and includes identification information associated with the autorack to a known authentication entity. In particular embodiments the authorized person may send a text message using a cell phone. For example, the operator authorized to load or unload vehicles from an autorack railcar may text an access code reset request including identification information printed on the storage box to the phone number of a known authentication entity.

At step 614, the authentication entity authenticates the sender (i.e., the authorized person). In particular embodiments, the authentication entity may authenticate the sender by comparing the sender's device identification with an approved list of devices and associated autoracks. Other embodiments may use any suitable form of device authentication.

At step 616, the authentication entity sends a message back to the sender (i.e., the authorized person) with a new access code for the storage box. In particular embodiments, the authentication entity may send a text message containing a new access code to the authorized person's cell phone.

At step 618, the authorized person enters the code at a storage box keypad. For example, the operator authorized to load or unload vehicles from an autorack railcar enters the access code received in a text message on a keypad associated with the storage box inside the autorack railcar.

At step 620, the authorized person opens the storage box, places an item in the storage box, and locks the storage box. For example, after loading vehicles in an autorack railcar, the operator may place the vehicle keys in the storage box and lock the storage box.

Modifications, additions, or omissions may be made to the method of FIG. 6. Additionally, one or more steps in method 600 of FIG. 6 may be performed in parallel or in any suitable order.

In particular embodiments, wireless technology may be used to unlock the key box remotely. In some embodiments, wireless or other electronic means may be used to automatically unlock the key box based on the autorack location as determined by global position sensing or proximity sensing, such as radio frequency identification. Electrical keypad style locks may employ a type of energy storage device, such as a battery, to maintain the stored code and facilitate operation.

In particular embodiments, the storage box may contain a wireless transceiver, memory, and a processor. In some embodiments, the transceiver facilitates transmitting wireless signals to and receiving wireless signals from a wireless network (e.g., via an antenna), the processor executes instructions to provide some or all of the functionality described herein as provided by the storage box, and the memory stores the instructions executed by the processor.

The processor includes any suitable combination of hardware and software implemented in one or more integrated circuits or modules to execute instructions and manipulate data to perform some or all of the described functions of the storage box. In some embodiments, the processor may include, for example, one or more computers, one or more programmable logic devices, one or more central processing units (CPUs), one or more microprocessors, one or more applications, and/or other logic, and/or any suitable combination of the preceding. The processor may include analog and/or digital circuitry configured to perform some or all of the described functions of the storage box. For example, the processor may include resistors, capacitors, inductors, transistors, diodes, and/or any other suitable circuit components.

The memory is generally operable to store computer executable code and data. Examples of memory include computer memory (e.g., Random Access Memory (RAM) or Read Only Memory (ROM)), mass storage media (e.g., a hard disk), removable storage media (e.g., a Compact Disk (CD) or a Digital Video Disk (DVD)), and/or or any other volatile or non-volatile, non-transitory computer-readable and/or computer-executable memory devices that store information.

In particular embodiments, access to the storage box may be coupled with various safety features. For example, an autorack railcar may include three key lock boxes, one on each level of a tri-level autorack railcar. The access mechanism of the key lock box may be communicably coupled to a sensor that detects whether the loading/unloading ramp for the particular level is securely in place. If the loading/unloading ramp is not securely in place, then the key lock box will not open even if the correct key or access code is used.

In particular embodiments, the storage box may be positioned in a railcar such that access may only be obtained when the railcar doors are opened. For example, a storage box may be positioned such that the door or opening of the storage box is only accessible when the autorack doors are open. When the autorack doors are closed, access to the key box is obstructed by the autorack doors themselves.

Figure 7A:
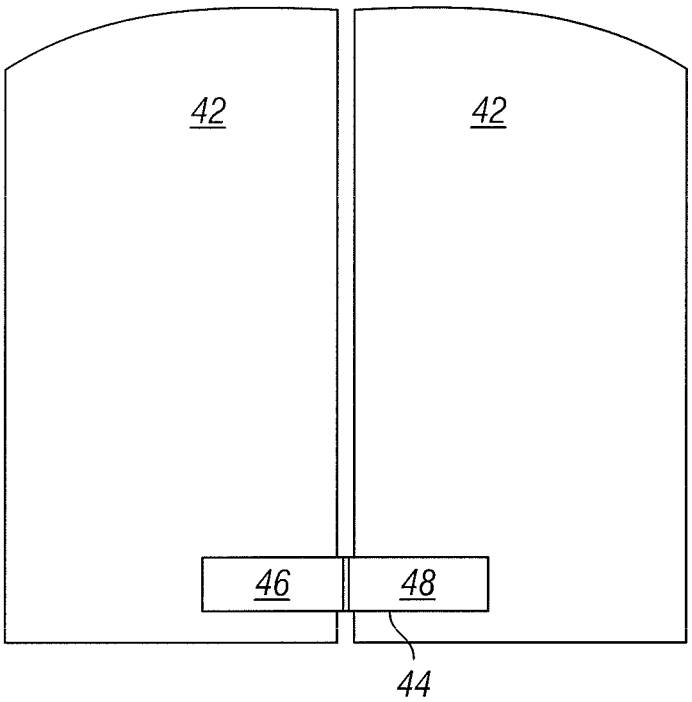
FIG. 7A is a schematic diagram of example autorack railcar doors in a closed position with integrated storage box viewed from inside an autorack railcar, according to particular embodiments.
Figure 7B:
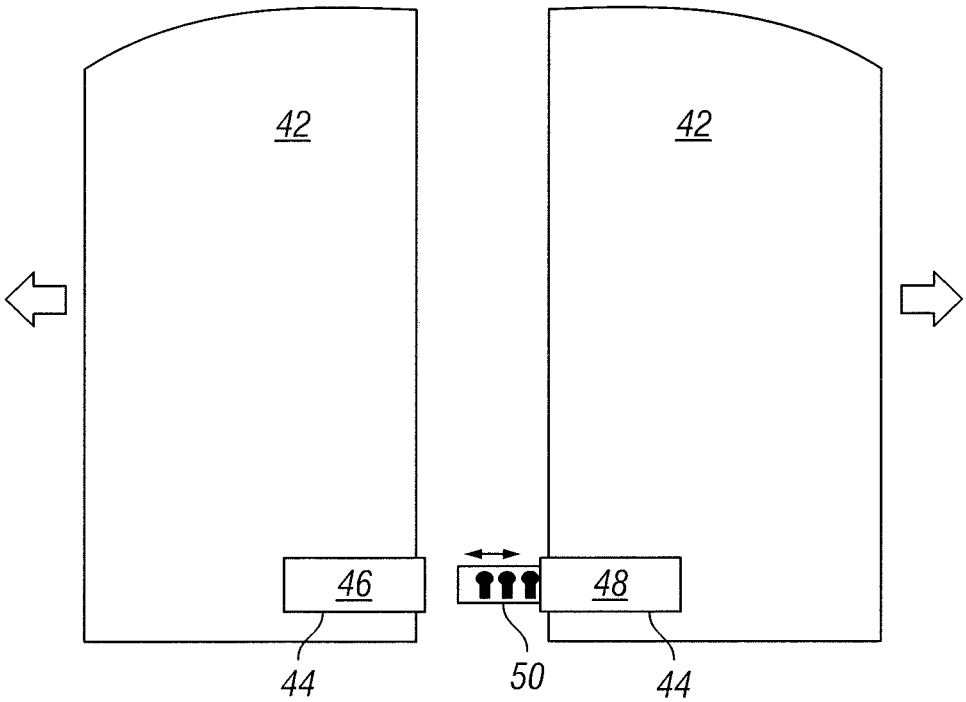
FIG. 7B is a schematic diagram of example autorack railcar doors in a partially open position with integrated storage box viewed from inside an autorack railcar, according to particular embodiments.

FIG. 7A is a schematic diagram of example autorack railcar doors in a closed position with integrated storage box viewed from inside an autorack railcar, according to particular embodiments. The example autorack railcar includes end doors 42. End doors 42 are hinged at the sides of the autorack railcar and open from the middle. Storage box 44 is coupled to end doors 42.

Storage box 44 comprises left portion 46 and right portion 48. Left portion 46 is coupled to left end door 42 and right portion 48 is coupled to right end door 42. One or both of left portion 46 and right portion 48 may include storage for keys, key fobs, or other items. One or both of left portion 46 and right portion 48 may include an opening at the end proximate the center of autorack railcar 40. The opening enables an operator to access the contents of the storage compartment. In particular embodiments, both left portion 46 and right portion 48 may comprise a door covering the opening proximate the center of autorack railcar 40.

When end doors 42 are closed, left portion 46 prevents access to right portion 48 and vice versa. When end doors 42 are open, left portion 46 and right portion 48 swing away from each other providing access to each portion of storage box 44, as illustrated in FIG. 4B.

FIG. 4B is a schematic diagram of example autorack railcar doors in a partially open position with integrated storage box viewed from inside an autorack railcar, according to particular embodiments. In the open position, the space between the open sides of end doors 42 facilitates access to one or both of left portion 46 and right portion 48 of storage box 44.

In particular embodiments, one or both of left portion 46 and right portion 48 may include sliding key panel 50. Sliding key panel 50 retains keys and may slide out of left portion 46 or right portion 48 to facilitate easier access to the keys (or other contents of storage box 44).

In the illustrated embodiment, storage box 44 is positioned near the bottom of end doors 42. A particular advantage is that storage box 44 may be accessible to an operator inside the autorack railcar as well as an operator standing on the ground outside the autorack railcar when end doors 42 are open. In other embodiments, storage box 44 may be located at any suitable location on end doors 42. In particular embodiments, one or both of left portion 46 and right portion 48 may only serve to block access to the other portion when end doors 42 are closed but may not include storage space. For example, one or both of left portion 46 and right portion 48 may comprise a metal plate that blocks access to the other portion when end doors 42 are closed.

Other embodiments may locate a storage box in other locations only accessible when the railcar doors are open. For example, some embodiments may locate a storage box in the floor of the railcar underneath the railcar doors so that the storage box door or opening is only accessible when the end doors are open.

Figure 8A:
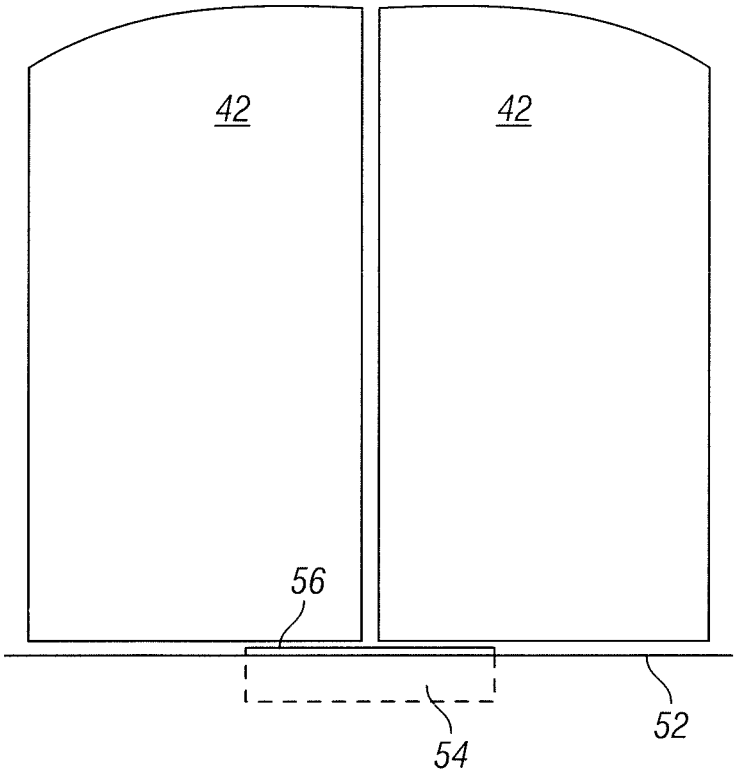
FIG. 8A is a schematic diagram of example autorack railcar doors in a closed position with storage box integrated into the autorack railcar floor viewed from inside the autorack railcar, according to particular embodiments.

FIG. 8A is a schematic diagram of example autorack railcar doors in a closed position with storage box integrated into the autorack railcar floor viewed from inside the autorack railcar, according to particular embodiments. The example autorack railcar includes end doors 42 and floor 52. End doors 42 are hinged at the sides of the autorack railcar and open from the middle. Storage box 54 is recessed into floor 52 and located underneath end doors 42. In particular embodiments, storage box 54 includes lid 56.

When end doors 42 are closed, they block access to lid 56, which prevents access to storage box 54. In the open position, end doors 42 do not block access to lid 56, which permits access to storage box 54, as illustrated in FIG. 8B.

Figure 8B:
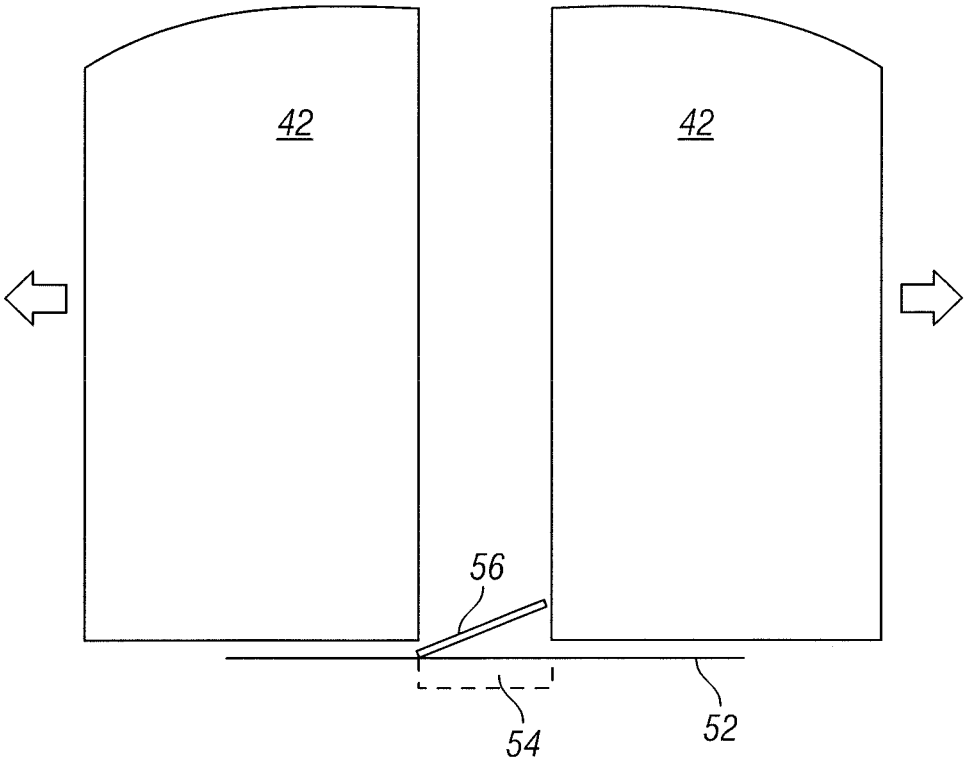
FIG. 8B is a schematic diagram of example autorack railcar doors in a partially open position with storage box integrated into the autorack railcar floor viewed from inside the autorack railcar, according to particular embodiments.

FIG. 8B is a schematic diagram of example autorack railcar doors in a partially open position with storage box integrated into the autorack railcar floor viewed from inside the autorack railcar, according to particular embodiments. In the open position, end doors 42 swing away from lid 56 permitting access to storage box 54.

In particular embodiments, the storage boxes described with respect to FIGS. 7A-8B do not have their own locking mechanism. When end doors 42 are unlocked and open, the storage box is accessible. When end doors 42 are closed and locked, the storage box is not accessible. A particular advantage is that access to storage box is maintained in the same manner as access to the railcar. Thus, a separate system to transfer storage box keys or access codes is unnecessary. In other embodiments, the storage boxes described with respect to FIGS. 7A-8B may include their own locking mechanism, such as any of the locking mechanisms described above with respect to FIGS. 1-6.

A key box may be used to store keys, tools, or codes used to gain access to a control cabinet or railcar systems or components. In particular embodiments, a key box may contain a key used for access to a cabinet containing control valves on a cryogenic tank car. In some embodiments, a locking system similar to those described above may be used to gain or prevent access to a control system for other systems on a railcar, such as a refrigeration system on a box car, a programmable logic controller on a tank car, etc.

The key box lock box is applicable to either new railcars or may be retrofitted to existing railcars.

Modifications, additions, or omissions may be made to the systems and apparatuses disclosed herein without departing from the scope of the invention. The components of the systems and apparatuses may be integrated or separated. Moreover, the operations of the systems and apparatuses may be performed by more, fewer, or other components.

Modifications, additions, or omissions may be made to the methods disclosed herein without departing from the scope of the invention. The methods may include more, fewer, or other steps. Additionally, steps may be performed in any suitable order.

Although embodiments of the present disclosure and their advantages have been described in detail, it should be understood that various changes, substitutions and alternations can be made herein without departing from the spirit and scope of the invention as defined by the example embodiments below.

The invention claimed is:

1. A railcar comprising:

a railcar door for accessing an interior of the railcar;

a storage box comprising an access opening, the storage box disposed such that when the railcar door is in a closed position, the railcar door prevents access to the storage box access opening, and when the railcar door is in an open position, the storage box access opening is accessible; wherein:

the railcar door comprises a double door, the double door comprising a first portion and a second portion; and the storage box comprises a first portion coupled to the first portion of the double door and a second portion coupled to the second portion of the double door and adjacent to the first portion of the storage box, the first portion of the storage box positioned such that the first portion of the storage box prevents access to the second portion of the storage box when the double doors are in a closed position.

2. The railcar of claim 1, wherein the first portion of the storage box and the second portion of the storage box are positioned such that the second portion of the storage box is accessible when the double doors are in an open position.

3. The railcar of claim 1, wherein the second portion of the storage box further comprises a sliding panel.

4. The railcar of claim 1, further comprising a railcar floor, and wherein the storage box is recessed into the railcar floor.

5. The railcar of claim 4, wherein the storage box is recessed into the railcar floor at least partially beneath the railcar door and disposed such that the access opening of the storage box is inaccessible when the railcar door is in a closed position.

6. The railcar of claim 5, wherein the storage box is recessed into the railcar floor at least partially beneath the railcar door and disposed such that the access opening of the storage box is accessible when the railcar door is in an open position.

7. The railcar of claim 1, wherein the railcar comprises an autorack railcar and the storage box comprises storage for keys of vehicles loaded in the autorack railcar.

* * * * *